United States Patent [19]

Schmekel et al.

[11] Patent Number: 4,641,667

[45] Date of Patent: Feb. 10, 1987

[54] PROCESS OF PREPARING NICOTINE N'-OXIDE AND SMOKING PRODUCTS CONTAINING IT

[75] Inventors: Gerald Schmekel, Elmshorn; Gert Rudolph, Hamburg, both of Fed. Rep. of Germany

[73] Assignee: B.A.T. Cigarettenfabriken GmbH, Fed. Rep. of Germany

[21] Appl. No.: 679,573

[22] Filed: Dec. 7, 1984

[30] Foreign Application Priority Data

Dec. 9, 1983 [DE] Fed. Rep. of Germany ..... 3344554

[51] Int. Cl.[4] ..... A24B 15/38; C07D 401/04

[52] U.S. Cl. ..... 131/352; 131/310; 131/297; 131/298; 546/282

[58] Field of Search ..... 131/297, 290, 309, 310, 131/298, 352; 546/282

*Primary Examiner*—V. Millin

*Attorney, Agent, or Firm*—Arnold, White & Durkee

[57] ABSTRACT

Smoking products, for example cigarettes, cut tobacco, pipe tobacco, cigarillos and the like, give an increased yield of nicotine in the tobacco smoke without impairment of the taste of the smoke, when trans-nicotine N'-oxide, which is free or substantially free of cis-nicotine N'-oxide or contains at most 10% by weight of the cis-isomer, is added thereto in a quantity of up to 5% by weight, relative to the dry weight of the tobacco. The nicotine N-oxide is prepared by oxidizing nicotine with an aqueous $H_2O_2$ solution in the presence of a catalytic amount of non-oxidizing acid having a pk value of less than 5 to produce an oxidation mixture containing trans and cis-nicotine N'-oxide.

27 Claims, No Drawings

PROCESS OF PREPARING NICOTINE N'-OXIDE AND SMOKING PRODUCTS CONTAINING IT

The invention relates to a smoking product, in particular tobacco with or without a wrapper material, which contains nicotine N'-oxide.

Furthermore, the invention relates to a process for the preparation of trans-nicotine N'-oxide, which is free or substantially free of cis-nicotine N'-oxide, in particular for use as an additive to smoking products of the invention.

The invention also relates to a process for the preparation of trans-nicotine N'-oxide which is free or substantially free of cis-nicotine N'-oxide. The process requires short reaction periods and only auxiliary substances which are acceptable under foodstuffs law are used.

SUMMARY OF INVENTION

A smoking product comprising tobacco and a quantity of up to about 5% by weight relative to the dry weight of the smoking product of nicotine N'-oxide. The nicotine N'-oxide is at least 90% trans-nicotine N'-oxide and at most 10% cis-nicotine N'-oxide.

A process for the preparation of trans-nicotine N'-oxide comprising oxidizing nicotine with an aqueous $H_2O_2$ solution in the presence of a catalytic amount of a non-oxidizing acid having a pK value of less than 5.

BACKGROUND OF THE INVENTION

It is known from "Die Nahrung", Volume 4, 1960, No. 4, pages 310–323, in particular page 322, Abstract or Summary, that nicotine N'-oxide contained in smoking tobacco forms nicotine on smoking and leads to an increase in the nicotine content of the mainstream smoke and slipstream smoke.

The invention is based on the discovery that the cis-isomer of nicotine N'-oxide causes a considerable deterioration in the taste of the smoke. Accordingly, the invention relates to a smoking product, the smoke of which has an increased nicotine content due to the addition of nicotine N'-oxide, wherein the above-mentioned impairment of the taste of the smoke by the cis-isomer is avoided.

The term "smoking product", used here, is to be understood as cut tobacco, pipe tobacco, cigarettes, cigarillos or cigars of tobacco with or without added non-tobacco materials and/or reconstituted tobacco. The smoking product of the invention can have been produced with or without a wrapper material, the possible wrapper materials used being cigarette paper, cigar wrappers or cigarillo wrappers of tobacco or non-tobacco materials.

Mixtures of isomers of nicotine N'-oxide were obtained for the first time by oxidation of nicotine with aqueous hydrogen peroxide, cf. Chem. Ber. 24, 61–67 (1891). An improvement of this process, using a nicotine/hydrogen peroxide molar ratio of 1:3, is described in J. Org. Chem. 24, 275–277 (1970). A particular disadvantage of this process is the long reaction period of 2–3 days and the large excess of oxidizing agents, which prohibits economical exploitation of this process. In addition, it was not possible to isolate the resulting mixture of isomers of nicotine N'-oxide; it was necessary to isolate and characterize the end products as the picrates.

Substantially shorter oxidation periods can be obtained in the preparation of the mixture of isomers of nicotine N'-oxide when the oxidation is carried out with organic peracids in accordance with J. Org. Chem. 35, 1721–1722 (1970). However, the desired reaction products require more elaborate purification work; in addition, such a process for the preparation of nicotine N'-oxides is uneconomical because of the high price of organic peracids.

DETAILED DESCRIPTION

The smoking product of the invention contains trans-nicotine N'-oxide in a quantity of up to 5% by weight relative to the dry weight of the smoking product. The trans-nicotine N'-oxide is free or substantially free of cis-nicotine N'-oxide or has a content of at most 10% by weight of the cis-isomer.

A content of at most 10% by weight of the cis-isomer in the trans-isomer can be present without adverse effects on the taste. Higher proportions of the cis-isomers of the order of magnitude of 10% to 30% by weight can be accepted, but the smoking product then requires certain taste-improving additives (flavors) to mask the disadvantageous taste of the cis-isomer. Even with taste additives, the disagreeable taste is not completely masked.

The trans-nicotine N'-oxide which is to be used according to the invention and which is free or substantially free of cis-nicotine N'-oxide or has a content of at most 10% by weight of the cis-isomer, can have been added to the tobacco or to the non-tobacco materials contained therein and/or to the wrapper materials which may be present, for example the cigarette paper or the cigar or cigarillo wrappers of tobacco and/or non-tobacco materials. Advantageously, the nicotine N'-oxide is added, for example in the form of an aqueous solution, to the finished tobacco material or, for example in an alcoholic or aqueous-alcoholic solution, to the finished wrapper material, or to both.

The process of the invention comprises carrying out the oxidation in the presence of catalytic amounts of non-oxidizing inorganic and/or organic acids having a pK value of less then 5. The reaction temperature during the conversion should in every case be as low as possible, since higher reaction temperatures promote the formation of decomposition products and of the cis-isomer, even though the latter is produced only to a small extent. The reaction temperature should never be above 90° C., since otherwise explosive decompositions of the hydrogen peroxide can occur. Suitable catalytically active acids having pK values of less than 5 are monocarboxylic, dicarboxylic or polycarboxylic acids and their hydroxy derivatives, keto derivatives or unsaturated derivatives. The use of natural carboxylic, dicarboxylic or polycarboxylic acids occurring in tabacco, such as are known, for example, from Chem. Rev. 68. 169–171 (1968), in particular malonic, succinic and malic acid, is preferred. The use of citric acid is particularly preferred.

The reaction of nicotine with hydrogen peroxide preferably takes place in substantially equimolar amounts, hydrogen peroxide being introduced first and nicotine being added dropwise; the converse process is also possible. The oxidizing agent used advantageously is commercially available hydrogen peroxide in the form of a 35–50% aqueous solution.

The acids used as catalysts are preferably employed in a quantity of 10–150, in particular 20–100, mmol per mol of nicotine.

Separation of the trans-isomer prepared according to the invention is facilitated when the oxidation mixture obtained in the oxidation is dehydrated. The dehydration is preferably carried out by azeotropic distillation, using n-propanol as the azeotropic entrainer. Remaining traces of water can be removed from the reaction mixture thus dried by means of a molecular sieve (pore size 4 Å). The trans-nicotine N'-oxide crystallizes in a pure form out of the dry oxidation mixture. It can be added to the tobacco and/or to the wrapper material in the manner described above. It is possible to extend it, for cost reasons, with up to 10% by weight of the cis-isomer.

The remaining cis-isomer left after working-up of the oxidation mixture is advantageously reduced to nicotine; the nicotine thus obtained can be oxidized again.

The oxidation of nicotine with hydrogen peroxide is exothermic and therefore causes safety problems. On an industrial scale, the process of the invention is therefore appropriately carried out in partially continuous operation. Hydrogen peroxide is introduced first and nicotine is added batchwise for regulating the reaction rate and the heat evolved. A particular advantage of the process of the invention is that, surprisingly, a colorless oxidation mixture is obtained when the catalysts according to the invention are used.

The process of the invention is explained in more detail below by reference to preferred illustrative embodiments.

EXAMPLE 1

Preparation of a cis/trans mixture of nicotine N'-oxide 500 g of nicotine (3.08 mol) are slowly added dropwise to an equimolar 30% hydrogen peroxide solution containing 5.9 g of citric acid (30.8 mmol), the temperature being maintained below 90° C. After the addition has ended, the mixture is heated at 80° C. for 5 hours.

The colorless solution which is thus obtained and is free of nicotine and hydrogen peroxide can be directly processed further.

EXAMPLE 2

Preparation of pure trans-nicotine N'-oxide

The solution obtained in Example 1 is dehydrated by azeotropic distillation with n-propanol. The dehydrated solution is finally dried with a molecular sieve (4 Å). On cooling, pure trans-nicotine N'-oxide which can be filtered off with suction crystallizes out of the mixture thus obtained. The residual mother liquor contains predominantly cis-nicotine N'-oxide.

The method described here for the separation of the trans-isomer from the cis-isomer is considerably simpler than the process described for only analytical quantities in Phytochemistry, 14. 2683–2690 (1975), Pergamon Press, or in Biochemical Pharmacology 19, 733–742 (1970).

EXAMPLE 3

Preparation of trans-nicotine N'-oxide on a semi-technical scale and in partially continuous operation In a reactor with an agitator, 7.75 kg of 30% hydrogen peroxide solution (68 mol) and 125 g of citric acid (0.65 mol) are introduced first and heated to 40° C.; the preheating is important for a rapid establishment of the operating point during the addition of nicotine and must therefore be carried out with care. Subsequently, 10 kg of nicotine (61.8 mol) are introduced into the reactor ($V_{Ni}$=5 l/h), the operating point of about 80° C. being established by means of the heat of reaction evolved. After nicotine has been introduced for two hours, the reaction is completed in batch operation at 80° C., with supply of heat. The conversion/time curve can be monitored spectroscopically, iodometrically or electrochemically.

After a total reaction period of 5 hours, a nicotine conversion of 98% is obtained; the residual hydrogen peroxide content is 1.5%. The resulting oily solution of the oxidation products has a yellowish color and exhibits no odor of nicotine.

The mixture obtained has a cis/trans ratio of the nicotine N'-oxides of 1:1.67.

25 kg of n-propanol are added to the crude product thus obtained and the mixture is distilled. n-Propanol/water in a ratio of 75–25 then distills off as the azeotrope. The reaction residue thus dehydrated is then finally dried with 5 kg of molecular sieve (4 Å) in 5 kg of methylene chloride.

Pure trans-nicotine N'-oxide (4 kg; melting point 171°–173° C.) crystallizes out of the dry reaction mixture. It is filtered off with suction, with addition of 5 kg of acetone, and is dried in a drying cabinet at 60° C.

Yield: 36.4% relative to nicotine employed, and 58.7% relative to trans-nicotine N'-oxide formed.

EXAMPLE 4

In a reactor with agitator, 10 kg of nicotine (61.8 mol) are introduced first and preheated to about 40° C. Subsequently, 4.62 kg (68 mol) of 50% $H_2O_2$, to which 125 g of citric acid (0.65 mol) have been added, are fed very slowly to the reactor with the aid of a metering pump. The rate of addition is adjusted such that a reaction temperature of about 80° C. is obtained. The volumetric flow fed in depends on the reaction control, more rapid heat removal being ensured by built-in cooling, so that the feed volume per unit time can be increased. After the hydrogen peroxide has been introduced (about 2 hours), the reaction is completed at 80° C. with heat being supplied. With a total reaction period of about 5 hours, a nicotine conversion of 98% is obtained; the residual hydrogen peroxide content is 1.5% by mass. The residue obtained is slightly yellow and exhibits no odor of nicotine. The cis/trans ratio of the two diastereomeric nicotine N'-oxides is 1:1.67.

The reaction mixture is subjected to azeotropic dehydration. For this purpose, 10.6 kg of n-propanol are added, and a water-containing distillate (75% by mass of n-propanol/25% of water) is separated off under a slight vacuum.

The residue is low in water and has a residual water content of 7.7% by mass.

EXAMPLE 5

Nicotinization of a cigarette rod

The nicotine content of tobacco is raised by 1.13% to 2.62% by means of a 10% alcoholic solution of trans-nicotine N'-oxide; the addition is effected by spraying onto the tobacco material.

The cigarettes produced from the tobacco material thus obtained have, in a smoking test under DIN conditions, a smoke nicotine yield which is increased by 0.3 mg. The condensate content remains unchanged as compared with untreated cigarettes.

EXAMPLE 6

Cigarette rod nicotinization

A tobacco mixture having a nicotine content of 1.66% is raised to 6.1% nicotine content in the cut leaf by means of a 20% aqueous trans-nicotine N'-oxide solution. The cigarettes subsequently produced from this tobacco material give, in a smoking test under DIN conditions, a smoke nicotine yield which is increased by 0.5 mg. The condensate content did not change compared with untreated cigarettes.

EXAMPLE 7

Nicotinization of cigarette paper 200 m of a cigarette paper web are moistened on the back by means of rollers with a 10% trans-nicotine N'-oxide solution in water/ethanol (1:1) and dried in a stream of hot air. After drying, the cigarette paper obtained resembles the untreated sample with respect to color and mechanical strengh, and contributes to a nicotine increase in the smoke. The quantity of trans-nicotine N'-oxide applied according to the process is 5% relative to the weight of the cigarette paper.

EXAMPLE 8

Nicotine compensation by addition of trans-nicotine N'-oxide before an expansion process 50 kg of a filler grade having a nicotine content of 1.8% by weight and a moisture content of 11% by weight are brought to an expansion moisture content of about 18% by weight by means of a trans-nicotine N'-oxide solution consisting of 4.3 l of water and 200 g of trans-nicotine N'-oxide.

The quantity of trans-nicotine N'-oxide applied compensates the 25% nicotine loss, which is always to be expected in tobacco expansion processes, so that the expanded tobacco can contribute with its original nicotine content to the preparation of the mixture.

This example clearly shows the advantage obtainable with an addition of trans-nicotine N'-oxide in tobacco material, the volume of which is to be increased in a conventional expansion step; this expansion is always connected with a loss of nicotine.

What is claimed is:

1. A smoking product comprising tobacco and a quantity of up to 5% by weight relative to the dry weight of the smoking product of nicotine N'-oxide, said nicotine N'-oxide consisting of at least 90% of the trans-isomer and at most 10% of the cis-isomer of nicotine N'-oxide.

2. The smoking product of claim 1 wherein said nicotine N'-oxide is substantially free of the cis-isomer.

3. The smoking product of claims 1 or 2 wherein said nicotine N'-oxide is added to the tobacco.

4. The smoking product of claims 1 or 2 wherein said product further comprises a wrapper material and said nicotine N'-oxide is added to the wrapper material.

5. The smoking product of claim 4 wherein said nicotine N'-oxide is added to both the wrapper material and to the tobacco.

6. A process for the preparation of trans-nicotine N'-oxide comprising oxidizing nicotine with an aqueous $H_2O_2$ solution in the presence of a catalytic amount of non-oxidizing acid having a pK value of less than 5 to produce an oxidation mixture containing trans and cis-nicotine N'-oxide.

7. The process of claim 6 wherein said acid comprises a carboxylic, dicarboxylic or polycarboxylic acid naturally occurring in tobacco.

8. The process of claim 7 wherein said oxidation mixture is dehydrated.

9. The process of claim 8 wherein said dehydration is carried out by azeotropic distillation.

10. The process of claim 9 wherein n-propanol is used as the azeotropic entrainer.

11. The process of claim 10 wherein a molecular sieve is used to further dehydrate said oxidation mixture.

12. The method of claims 8, 9, 10 or 11 wherein trans-nicotine N'-oxide is separated from the dehydrated reaction mixture.

13. The process of claim 7 wherein said $H_2O_2$ and said nicotine are added in substantially equimolar quantities.

14. The process of claim 13 wherein said nicotine is added to said $H_2O_2$.

15. The process of claim 14 wherein said $H_2O_2$ is added to said nicotine.

16. The process of claims 13, 14 or 15 wherein said aqueous $H_2O_2$ is a 30% to 50% solution.

17. The process of claim 7 wherein said acid is added in the amount of about 10 to about 150 mmol per mol of nicotine.

18. The process of claim 17 wherein said acid is citric acid.

19. A process for the preparation of trans-nicotine N'-oxide comprising:

oxidizing nicotine with an aqueous $H_2O_2$ solution in the presence of about 10 to about 150 mmol per mol nicotine of a non-oxidizing carboxylic, dicarboxylic or polycarboxylic acid naturally occurring in tobacco and having a pK value of less than 5 to produce an oxidation mixture containing trans and cis-nicotine N'-oxide, dehydrating said oxidation mixture; and separating trans-nicotine N'-oxide from said dehydrated oxidation mixture.

20. The process of claim 19 wherein said dehydration is carried out by azeotropic distillation.

21. The process of claim 20 wherein said acid is citric.

22. The process of claim 21 wherein n-propanol is used as the azeotropic entrainer.

23. The process of claim 22 wherein a molecular sieve is used to further dehydrate said oxidation mixture.

24. A smoking product comprising tobacco and a quantity of up to 5% by weight relative to the dry weight of the smoking product of trans-nicotine N'-oxide, said trans-nicotine N'-oxide being substantially free of the cis-isomer of nicotine N'-oxide.

25. The smoking product of claim 24 wherein said trans-nicotine N'-oxide is added to the tobacco.

26. The smoking product of claim 24 wherein said product further comprises a wrapper material and said trans-nicotine N'-oxide is added to the wrapper material.

27. The smoking product of claim 26 wherein said trans-nicotine N'-oxide is added to both the wrapper material and to the tobacco.

* * * * *